United States Patent [19]

Sundermeyer

[11] Patent Number: 4,831,935

[45] Date of Patent: May 23, 1989

[54] METHOD AND UTILIZATION OF FINAL FLIGHT PHASE-CORRECTED SUBMUNITION FOR THE ATTACKING OF ARMORED SHELTERS CROSS-REFERENCE TO RELATED APPLICATIONS

[75] Inventor: Peter Sundermeyer, Lauf/Pegn, Fed. Rep. of Germany

[73] Assignee: Diehl GmbH & Co., Nurnberg, Fed. Rep. of Germany

[21] Appl. No.: 182,779

[22] Filed: Apr. 18, 1988

Related U.S. Application Data

[63] Continuation-in-part of Ser. No. 885,003, Jul. 14, 1986, abandoned.

[30] Foreign Application Priority Data

Aug. 1, 1985 [DE] Fed. Rep. of Germany ..... 3527522

[51] Int. Cl.[4] ..... F42B 13/10; F42B 15/26; F42B 25/08; F42B 25/16

[52] U.S. Cl. ..... 102/384; 102/476; 102/489

[58] Field of Search ..... 102/383, 386, 387, 476, 102/489, 306, 393, 384

[56] References Cited

U.S. PATENT DOCUMENTS

| | | | |
|---|---|---|---|
| 3,948,175 | 4/1976 | Bucklisch | 102/383 |
| 3,978,797 | 9/1976 | Herrington et al. | 343/770 |
| 4,009,661 | 3/1977 | Dodd | 102/480 |
| 4,050,381 | 9/1977 | Heinemann | 102/476 |
| 4,063,512 | 12/1977 | Davis | 102/476 |
| 4,175,491 | 11/1979 | Thomanek | 102/476 |
| 4,296,685 | 10/1981 | Romer et al. | 102/387 |
| 4,492,166 | 1/1985 | Purcell | 102/383 |
| 4,522,356 | 6/1985 | Lair et al. | 102/489 |
| 4,538,519 | 9/1985 | Witt et al. | 102/387 |
| 4,554,871 | 11/1985 | Nixon | 102/489 |
| 4,565,341 | 1/1986 | Zacharin | 102/386 |
| 4,568,040 | 2/1986 | Metz | 102/384 |
| 4,622,900 | 11/1986 | Witt et al. | 102/387 |

FOREIGN PATENT DOCUMENTS

| | | | |
|---|---|---|---|
| 2156974 | 9/1979 | Fed. Rep. of Germany | 102/480 |
| 2552870 | 4/1985 | France | 102/476 |

*Primary Examiner*—David H. Brown

*Attorney, Agent, or Firm*—Scully, Scott, Murphy & Presser

[57] ABSTRACT

A method of attacking aboveground armored objects, in particular those which are employed for sheltering aircraft; and moreover, to the utilization of steeply descending final flight phase-corrected submunition. The shelter is attacked in an orientation directed generally horizontally against its gate. Furthermore, in the utilization of steeply descending submunition of the type which is employed for implementing the foregoing method, this includes at least one projectile-forming covering oriented genrally transversely of the longitudinal axis thereof, and with a maneuvering sensor responsive to the center of a typical aircraft apron clutter signature in front of an aircraft shelter.

6 Claims, 1 Drawing Sheet

METHOD AND UTILIZATION OF FINAL FLIGHT PHASE-CORRECTED SUBMUNITION FOR THE ATTACKING OF ARMORED SHELTERS CROSS-REFERENCE TO RELATED APPLICATIONS

CROSS-REFERENCE TO RELATED APPLICATIONS

This application is a continuation-in-part application of U.S. Ser. No. 885,003; filed on July 14, 1986.

BACKGROUND OF THE INVENTION

1. Field of the Invention

The present invention relates to a method of attacking aboveground armored target objects, in particular those which are employed for the sheltering of aircraft; and moreover, the invention relates to the utilization of steeply descending submunition having a final flight phase-corrected trajectory.

2. Discussion of the Prior Art

From the disclosure of MILITARY TECHNOLOGY 2/85 (page 72, middle towards the left) there has become known a so-called anti-shelter weapon, which is employed for the attacking of aboveground armored shelters (dugouts) which are installed on airbases, and against the aircraft parked therein, wherein the submunition which is fired thereagainst in the form of dispersed or scatter ammunition is equipped with a drive or propulsion unit in order to enable it to penetrate the soil wall surrounding a shelter. In that instance, the submunition utilizes a tandem charge consisting of a forwardly-oriented shaped charge and an auxiliary charge for bursting open the concrete shelter armoring, and for the attacking the aircraft which is parked therein through the intermediary of fragments. Should, by accident or chance, the scatter ammunition at any time not land on the ground, but strike directly against the armored gate of the shelter, then, without any precedent ignition of the drive unit, the tandem charge will be immediately triggered.

However, the technological demands on the practical implementation realization of such a submunition is extremely considerable; whereas, on the other hand, there can be expected only a limited effect in the target, inasmuch as only a relatively small percentage of the scattered submunition will accidentally or by chance strike the soil cover on the earth embankment extending over the shelter; in effect, so as to actually attack a protectedly parked aircraft. In addition, it is hardly possible that for penetrating the earth or soil walls of shelters possessing a thickness of more than a few meters, to be able to arrange a drive or propulsion unit within the typical dimensions of submunition with representable requirements, whose capacity or power for the forward thrust through the earth or soil wall is adequate to reach to the reinforced concrete shelter armoring. However, at a detonation of the tandem charge which is already within the soil wall, at a distance from the concrete shell of the shelter, there can no longer be expected any penetration of this armoring, inasmuch as the effect of the tandem charge essentially only unfolds during the penetration of the concrete member itself, and in contrast therewith the energy thereof will dissipate within the earth embankment located in front thereof. Finally, the probability that the scatter ammunition, which is equipped with stabilizing fins but which, for the remainder, is free-falling in its trajectory, will strike the armored gate with any degree of hitting accuracy, wherein the gate is set back relative to the forward face of the shelter rearwardly of the armoring, is extremely low.

SUMMARY OF THE INVENTION

Accordingly, in recognition of these conditions it is an object of the present invention to provide an anti-shelter weapon which, with the lowest possible requirements from the standpoint of the ammunition technology, promises a higher degree of mission effectiveness than heretofore.

The foregoing is inventively achieved by a method as described herein, in which the shelter is attacked at an orientation which is directed generally horizontally against its gate. Furthermore, in the utilization of steeply descending submunition of the type which is employed in implementing the foregoing method, this includes at least one projectile-forming covering which is oriented generally transversely of the longitudinal axis thereof, and with the provision of a maneuvering sensor which is responsive to the center of a typical aircraft apron clutter signature located in front of a targeted aircraft shelter.

In order to attain the foregoing object, the premise is assumed that the most vulnerable part of an aircraft shelter is the gate thereof, and that this will also remain vulnerable inasmuch as, in the event of an alarm, the gate must be moved relatively quickly; in essence, because of mechanical and kinematic reasons it cannot be heavily armored to any considerable extent, and based upon the further concept, that at relatively low demands on target detection sensor technology, the gate can be acquired as a target object with an extremely high degree of probability; in effect, recognized, hit and destroyed, and even penetrated by red-hot masses of fragments for effectuating the destruction of the aircraft which are parked therebehind, when the ammunition drops into the aircraft turning location or apron in front of the shelter gate, and at least one projectile-forming charge fires in a generally horizontal orientation against the gate.

BRIEF DESCRIPTION OF THE DRAWINGS

Reference may now be had to the following detailed description of the inventive method for the attacking of above-ground armored target object, taken in conjunction with the accompanying generally diagrammatic drawings; in which:

FIG. 6 illustrates a typical target object which is being attacked by the article of submunition of FIG. 2.

DETAILED DESCRIPTION

Figure 3:
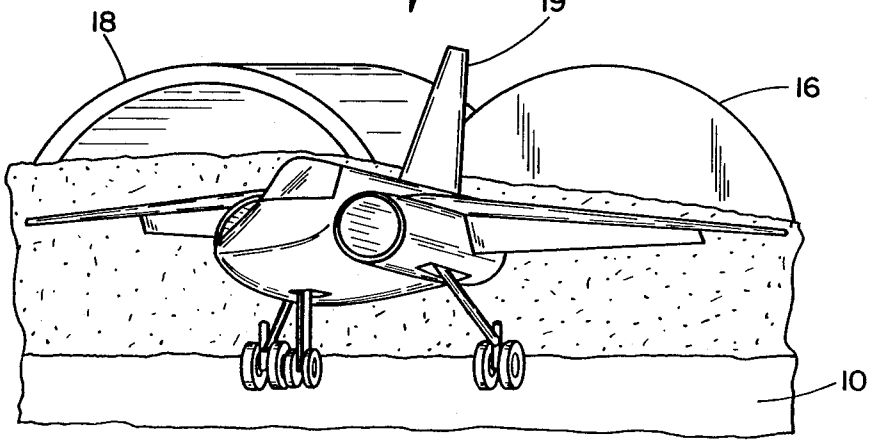
Figure 1:
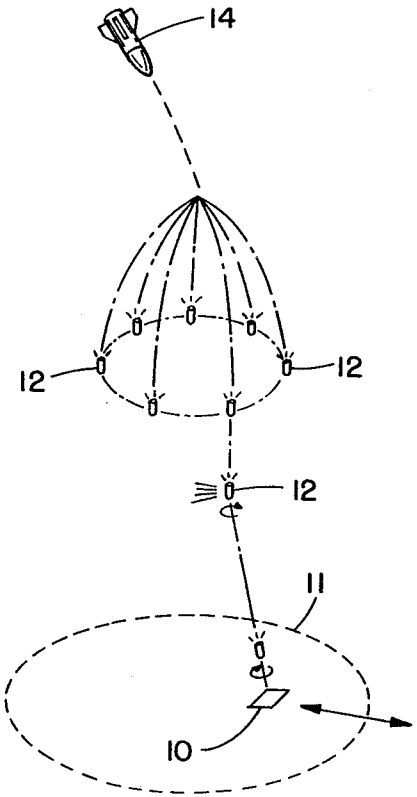
FIG. 1 (PRIOR ART)
FIG. 1 schematically illustrates an arrangement for the attacking of an above-ground target object, including an enlarged fragmentary view of the target area.

Referring to the drawings, and particularly FIGS. 1 and 3, an aircraft apron 10 within a target area 11 is relatively simply ascertainable by means of a target acquisition detector on board of articles of submunition 12 which are launched from a carrier missile 14; for example, upon detection of a target, such as the apron in front of the gate 16 of an aircraft shelter 18 (shown in an opened condition for the exit of an aircraft 19) which is protected by a soil or earth embankment. This is because it significantly distinguishes itself as a large-surfaced asphalt or concrete surface from the clutter received on board of the submunition 12, which clutter emanates from any bushes, sod or grass and the sand present in the more proximate surroundings about the place in front of the shelter gate 16. From a sensor 20 arranged in the nose of the submunition 12, information can be derived, possibly while the submunition is suspended from a parachute (not shown) to thereby enable the sensor 20 to scan the terrain, so as to initiate maneuvering commands for the final-phase flight correction of the submunition, as described in U.S. Pat. No. 4,568,040, in order to guide the submunition in a steep final approach trajectory towards generally the center of the shelter apron. The sensor 20 may be an infrared sensor such as is described in U.S. Pat. No. 4,492,166, or sensor, may be a millimeter-wave detector as disclosed in U.S. Pat. Nos. 4,568,040 or 3,978,797. The hit or strike probability, with respect to the turning location between a shelter gate and the connecting roadways or aircraft taxiways leading to the runways, is further enhanced when the sensor 20 for the final-phase flight maneuver is additionally designed for pattern recognition so as to, for example, process the widening of the connecting roadway to the turning apron and/or the typically somewhat arcuate or spoke-shaped fragmentation protective hill structure which encompasses such an aircraft turning location as a target criterium, without having to concurrently initiate any operation of elements in the signal processing technology for the detecting of constructional details which are typical of the protrusion of a bunker roof above the shelter gate 16, and which can be easily camouflaged through suitable configuration of the earth or soil wall or embankment arranged directly thereabove. Moreover, in this instance, there is no demand for any sensor signal processing, which would be otherwise need to be activated when a sensor-guided submunition is intended strike a moving target object, such as a vehicle or tank, in which different views thereof necessitate the application of different recognition patterns, and the evasive movement capabilities of the target object require a more complex aiming evaluation for a proportional navigation sequence; since in the present instance, the acquired target which is in the configuration of the shelter apron is clearly ascertained not only geometrically and with respect to its clutter structure, but in particular, is also represented as a stationary target.

Additionally, there can be contemplated a gate detection procedure which is predicated on the aspect that, by means of the forwardly inclined oriented control or guidance sensor 20, or by means of a generally horizontally oriented auxiliary sensor (not shown), there can be acquired the flat surface of the aircraft shelter gate 16 which is bounded between adjoining fragment-protective earth or soil walls or embankments on both sides thereof, so as to then detonate a generally horizontally oriented projectile-forming charge 22 in a warhead 24, for example, as shown in U.S. Pat. No. 4,175,491, pivoting in conjunction with the rotating ammunition into a direction facing towards the detected gate.

Particularly adapted as an article of submunition, within the scope of the present invention, is a missile or airborne body which has a correctable trajectory during its final phase of flight, pursuant to U.S. Pat. No. 4,568,040, which during a steep descent into a target area will spirally scan the latter, preferably with the characteristic motion of at least one rigidly built-in sensor 20, and upon recognition of the target object (in this instance, primarily the shelter apron 10), will undertake a correction in the trajectory by means of a temporary activation of control surfaces 16. Inasmuch as the effect within the target no longer depends upon the fact that the submunition will accidentally strike a shelter at any suitable location, but is guided in a controlled manner to the place in front of the most readily damageable shelter area; namely, the apron 10 in front of its gate 16, substantially lower technological demands are encountered for obtaining the same degree of effectiveness for the ammunition; in essence, for example, a substantially lesser number of articles of submunition can be deployed over the target area. Adapted for this positioning are carriers 14 which are in the form of projectiles, missiles, rockets, or manned/unmanned aircraft; however, the deployment is preferably effected by means of a remote-controlled warhead or weapon carrier which is ejectable from an aircraft, such as is described in WEHRTECHNIK 5/84 (page 16, upper left).

The detection of the target in the form of the widening and relatively flat surface location (for example, the surface bounding the flat shelter gate) from a surrounding field generating significant other kinds of clutter, is effected; for example, pursuant to the criteria described in German OS No. 34 34 326.

Figure 2:
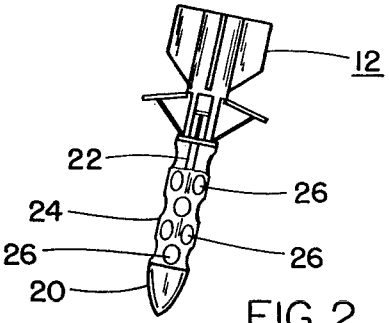
FIG. 2 (PRIOR ART)
FIG. 2 illustrates an article of submunition employable in implementing the inventive method.

The warhead 24 of the submunition 12, as shown in FIG. 2, possesses an essentially cylindrical structure, whose longitudinal axis is offset by the operationally typical angle of descent of the submunition into the target area relative to the longitudinal axis of the submunition 12 so as to be vertically oriented to the greatest possible extent at the point of impact. In this manner there is ensured that the projectile-forming coverings 26, which are arranged along the cylinder wall, will deform so as to lead to essentially horizontally-fired projectiles, of which at least one will strike perpendicularly against the surface of the armored gate 16 of the shelter 18 and penetrate the latter with red-hot fragments or splinters in order to disable or even destroy any aircraft parked within the shelter. Preferably, at least three, and typically about six projectile-forming coverings 26 are arranged on the warhead 24, offset thereabout relative to each other. From the geometry of the typical shelter apron, against which there is homed at generally the mid-point thereof (in effect, measured at a distance to the gate), and from the typical width of a shelter gate and from the horizontal angle between presently two mutually adjacent warhead coverings, even in the absence of any special gate detection, achieved is that a projectile will strike the gate generally centrally, or two projectiles will strike the gate at both of its side regions. However, it is possible to restrict oneself to one or only a few larger-sized projectile-forming charges when, additionally, there is achieved the above-mentioned acquisition of the gate, and the charge is detonated in a controlled manner upon turning into a sight line facing towards the gate. Furthermore, the warhead can also be equipped with a preacting covering, in order to additionally rupture or destroy the shelter apron in the vicinity of the point of impact of the submunition; in effect, to render it impossible for aircraft to travel thereover. To that extent, this pertains to the utilization of a so-called multi-purpose warhead, as is described in U.S. Pat. No. 4,690,062, issued Sept. 1, 1987, assigned to the common assignee of this application; pertaining to a cylindrical jacket covering for the warhead which is optimized with respect to another mission capability.

What is claimed is:

1. Method of attacking aboveground armored shelters, especially shelters for aircraft; comprising attacking said shelter by striking an aircraft apron in front of said shelter with maneuverable submunition guidable during the final flight phase thereof; said submunition having a warhead descending into an area in front of said gate, and said warhead including at least one projectile-forming covering for attacking the gate of said shelter in a generally horizontal direction; comprising controlling the final flight phase-maneuver of said submunition by sensing and evaluating significant distinctions between clutter generated by the apron and clutter generated by terrain surrounding said apron.

2. Method of attacking aboveground armored shelters, especially shelters for aircraft; comprising attacking said shelter by striking an aircraft apron in front of said shelter with maneuverable submunition guidable during the final flight phase thereof; said submunition having a warhead descending into an area in front of said gate, and said warhead including at least one projectile-forming covering for attacking the gate of said shelter in a generally horizontal direction; comprising controlling the final flight phase-maneuver of said submunition by sensing and evaluating the typical elevational profile in the surroundings of an apron proximate the shelter.

3. Method as claimed in claim 1 or 2, wherein said submunition possesses a plurality of mutually offset radial coverings which are deformable into projectiles; comprising attacking said shelter with said submunition in a steeply diving mode.

4. Method as claimed in claim 1 or 2, comprising controlling the final flight phase-maneuver of said submunition by spirally scanning the target area for acquiring the center of an apron proximate the shelter by a sensor in said submunition during descent in a spiral trajectory into the target area.

5. Method as claimed in claim 1, comprising evaluating the significant distinction between the clutter generated by the gate and that of the surrounding terrain, and in response thereto initiating the detonation of a projectile forming charge upon turning into a sight line facing towards the shelter gate.

6. Method as claimed in claim 1 or 2, comprising deploying the submunition over the target area through the intermediary of a self-maneuvering airborne carrier.

* * * * *

UNITED STATES PATENT AND TRADEMARK OFFICE

CERTIFICATE OF CORRECTION

PATENT NO. : 4,831,935

DATED : May 23, 1989

INVENTOR(S) : Peter Sundermeyer

It is certified that error appears in the above-identified patent and that said Letters Patent is hereby corrected as shown below:

Column 1, line 43: "implementation realization" should read as --implementation or physical realization--

Column 2, line 56: "FIG. 6" should read as --FIG. 3--

Column 3, line 17: "or sensor, may" should read as --or may--

Signed and Sealed this

Seventeenth Day of July, 1990

*Attest:*

HARRY F. MANBECK, JR.

*Attesting Officer*

*Commissioner of Patents and Trademarks*